US007290982B2

(12) United States Patent
Girard et al.

(10) Patent No.: US 7,290,982 B2
(45) Date of Patent: Nov. 6, 2007

(54) ARRANGEMENT FOR THE ATTACHMENT OF DISTRIBUTOR SECTORS SUPPORTING VANES AROUND AN ARC OF A CIRCLE

(75) Inventors: Patrick J. Girard, Melun (FR); Sebastien A. Imbourg, Yerres (FR); Philippe J. Pabion, Vaux le Penil (FR); Jean-Luc Soupizon, Vaux le Penil (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/957,690

(22) Filed: Oct. 5, 2004

(65) Prior Publication Data

US 2005/0042081 A1 Feb. 24, 2005

Related U.S. Application Data

(63) Continuation of application No. 10/359,222, filed on Feb. 6, 2003, now abandoned.

(30) Foreign Application Priority Data

Feb. 7, 2002 (FR) ..... 02 01460

(51) Int. Cl.
*F01D 11/12* (2006.01)
*F01D 9/04* (2006.01)

(52) U.S. Cl. ..... 415/173.4; 415/173.1; 415/173.5; 415/173.6; 415/189; 415/209.2; 415/209.3

(58) Field of Classification Search .. 415/173.1–173.6, 415/189–190, 209.2, 209.3, 209.4
See application file for complete search history.

(56) References Cited

U.S. PATENT DOCUMENTS 2,623,728 A * 12/1952 Feilden et al. ..... 415/209.3
2,693,904 A * 11/1954 Boyd ..... 415/144
2,834,537 A * 5/1958 Neary ..... 415/209.2
2,858,104 A 10/1958 Kelk et al.
2,942,844 A 6/1960 Neate
4,391,565 A * 7/1983 Speak ..... 415/189
4,529,355 A 7/1985 Wilkinson
5,288,206 A 2/1994 Bromann et al.
5,299,910 A 4/1994 Gilchrist
5,314,303 A 5/1994 Charbonnel et al.
5,462,403 A 10/1995 Pannone
6,341,938 B1 * 1/2002 Zegarski et al. ..... 415/173.4

FOREIGN PATENT DOCUMENTS

GB 856 599 12/1960

* cited by examiner

*Primary Examiner*—Christopher Verdier
(74) *Attorney, Agent, or Firm*—Oblon, Spivak, McClelland, Maier & Neustadt, P.C.

(57) ABSTRACT

The distributor sectors (25) of a turbomachine are secured adjacent to a casing (31) with sealing sectors (32) alternating with them in the axial direction. The distributor sectors (25) are provided with force resistant faces (37; 39) through which forces exerted on the distributor sectors are transmitted to the casing. The inner surface of the casing (31) is smoother and is not fitted with any hooks; consequently, this casing (31) is less complicated to make and is less mechanically stressed to retain the 10 distributor sectors, and the distributor sectors may be installed by a purely axial movement.

24 Claims, 2 Drawing Sheets

PRIOR ART

Figure 1:
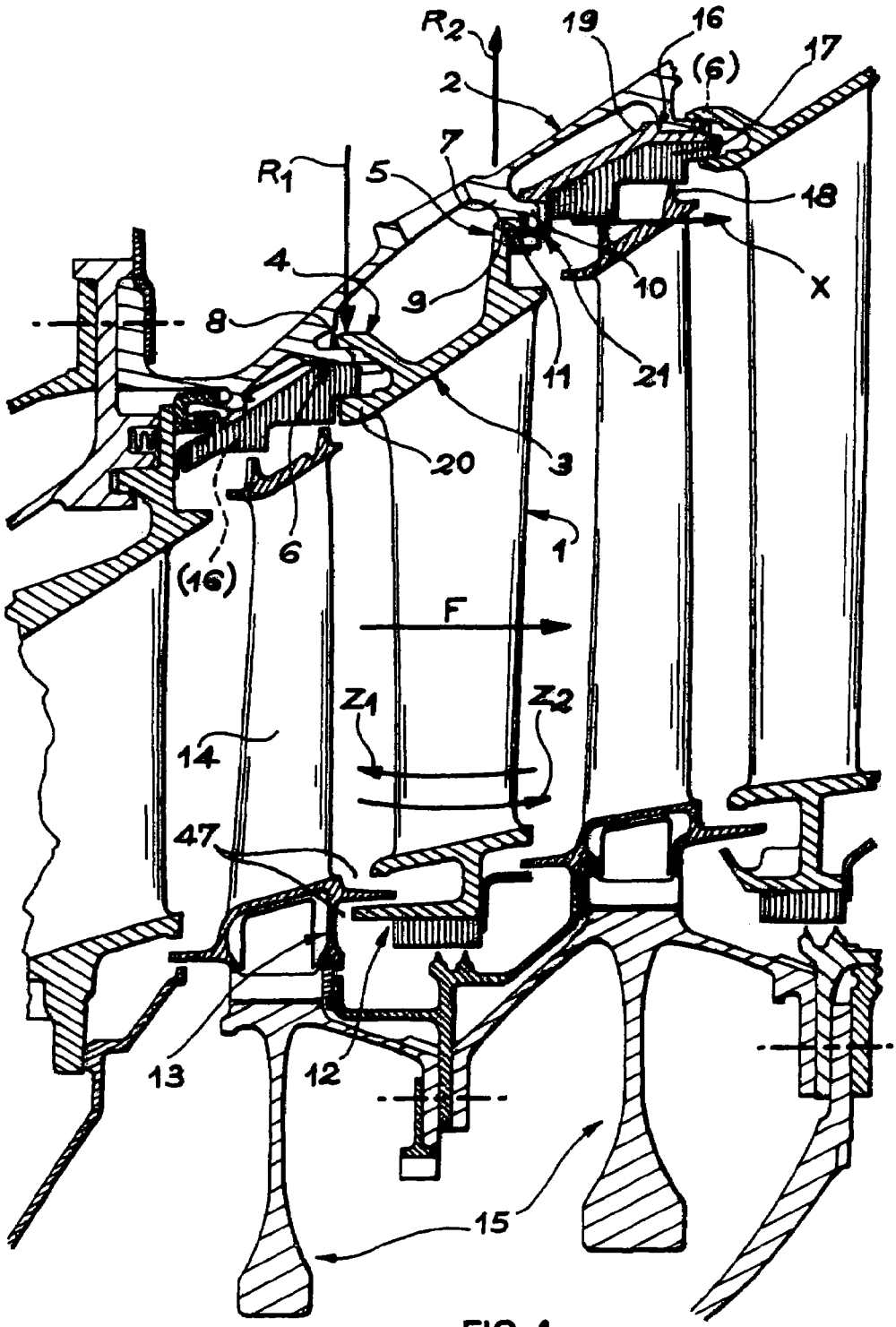

ARRANGEMENT FOR THE ATTACHMENT OF DISTRIBUTOR SECTORS SUPPORTING VANES AROUND AN ARC OF A CIRCLE

CROSS REFERENCE TO RELATED APPLICATIONS

This application is a continuation application of, and claims priority to, Ser. No. 10/359,222 filed Feb. 6, 2003 now abandoned, and claims priority to French Application Number 02 01460 filed Feb. 7, 2002.

This invention relates to an arrangement for the attachment of distributor sectors around the arc of a circle.

The distributors considered in this description are used in turbo machines and are fitted with vanes fixed to the stator with the function of straightening gas flows. Distributor sectors are installed inside the stator casing by interlocking hooks, allowing them to rest on bearing faces, some of which must resist the forces exerted on the distributor vanes. In the known embodiment in FIG. 1 in which the sectors are marked as reference 1 and the stator casing is marked as reference 2, the outer ring 3 of the distributor sectors 1 comprises an upstream tab 4 and a downstream tab 5, both hook shaped, and the casing 2 comprises upstream tabs 6 and downstream tabs 7 also hook shaped and associated in pairs with a given distributor. On the upstream side, the tab 4 of the sector 1 is engaged around the tab 6 of the casing 2, but on the downstream side the tab 7 of the casing 2 is engaged around the tab 5 of sector 1. This is justified if it is assumed that the forces F exerted on the distributor are essentially facing the downstream direction, and transmitted to the casing 2 partially in the form of a moment comprising a centripetal radial force R1 on the upstream side and a centrifugal force R2 on the downstream side. Therefore, the tabs 4 and 5 of the sectors 1 are bearing on the tabs 6 and 7 of the casing 2 at the contact faces 8 and 9 that are force resistant faces. The axial component of the forces F is also transmitted to the casing 2 through an axial force X exerted on the downstream side of the tab 5, at a curved hook shaped end 10 of the tab 7; therefore the contact face between the tab 5 and the end 10 is an axial force resistance face 11.

One disadvantage of this design is that the tabs 6 and 7 of the casing 2 are highly loaded, which is particularly problematic because their hook shape makes them weak and they become particularly hot under service conditions because they project into the gas stream, and the intrinsic strength of the material from which they are made may be weakened. The casing weight is increased by the tabs that have to be made solid, manufacturing becomes more difficult due to the complicated shape and in practice it must be constructed from a fairly noble material, which is not justified by the forces that it must resist in areas away from the tabs.

Another disadvantage of this design becomes clear during assembly; since the tab 5 on the downstream side of the sectors 1 passes below the curved hook shaped end 10, the sectors 1 must be presented obliquely, and then rotated after they are engaged behind the curved hook shaped end 10, to come into contact with the downstream force resistance face 9. The deflections Z1 and Z2 illustrate this inclination and then straightening movement of the sectors 1 during assembly. It can be seen that sufficient clearance has to be allowed between an inner ring 12 of the sectors 1 and an inner ring 13 of stages of vanes 14 of the rotor 15, so that leak tightness may not be very good at this location.

When the distributor sectors have been put into place, it is possible to install sealing sectors 16 on the downstream side that include an "abradable" material ring 17 that cooperates with lip seals 18 of the mobile vanes 14 to form labyrinth seals, which also include a support ring 19 for which the ends are configured to fit onto the tabs 6 and 7 of the casing 2. The attachment system is similar to the attachment system for the distributor sectors 1, since the ring 19 is supported on the upstream side on a radially outer face of one of the tabs (7) of the casing 2, and on the downstream side on a radially inner face of the other tab (6). Finally, the distributor and sealing sectors 1 and 16 that alternate in the machine in the axial direction are assembled to each other since the outer ring 3 of the distributor sectors 1 is provided with a tab 20 on the upstream side that is engaged in the downstream end of the adjacent sealing sectors 16, and the sealing sectors 16 also have an upstream tab 21 engaged under the downstream tab 5 of the adjacent ring 3 of the distributor 1. The tabs 20 and 21 hold the sectors 1 and 16 in position.

Document U.S. Pat. No. 4,529,355 describes an arrangement in which the casing supports the sealing and distributor sectors through spacers screwed onto it. Therefore it is smooth, but the hooks are on spacers that are heavy and cumbersome. Therefore this prior design seems to be even less attractive.

The present invention relates to an arrangement for attaching a different type of distributor sectors, the essential purpose of which is to avoid the use of hook shaped tabs belonging to the casing, in order to simplify the casing and to make the assembly of the distributor more convenient. The basic idea on which the invention is based is that the faces that resist forces in the axial and radial outwards directions are now located on the sealing sectors, the casing essentially providing only bearing faces that resist little or no load, such that the forces that it needs to resist will be very significantly reduced.

One significant form of the invention is characterized in that the distributor and sealing sectors comprise tabs with two axially opposite ends, the tabs of the distributor sectors are clamped between the tabs of the sealing sectors and the casing, and the sealing sectors are fixed to the casing by a median portion.

In some particular embodiments, an attempt is made to reduce forces transmitted to the casing by the sealing sectors, and particularly the moment resulting from forces produced on the different bearing faces.

Figure 2:
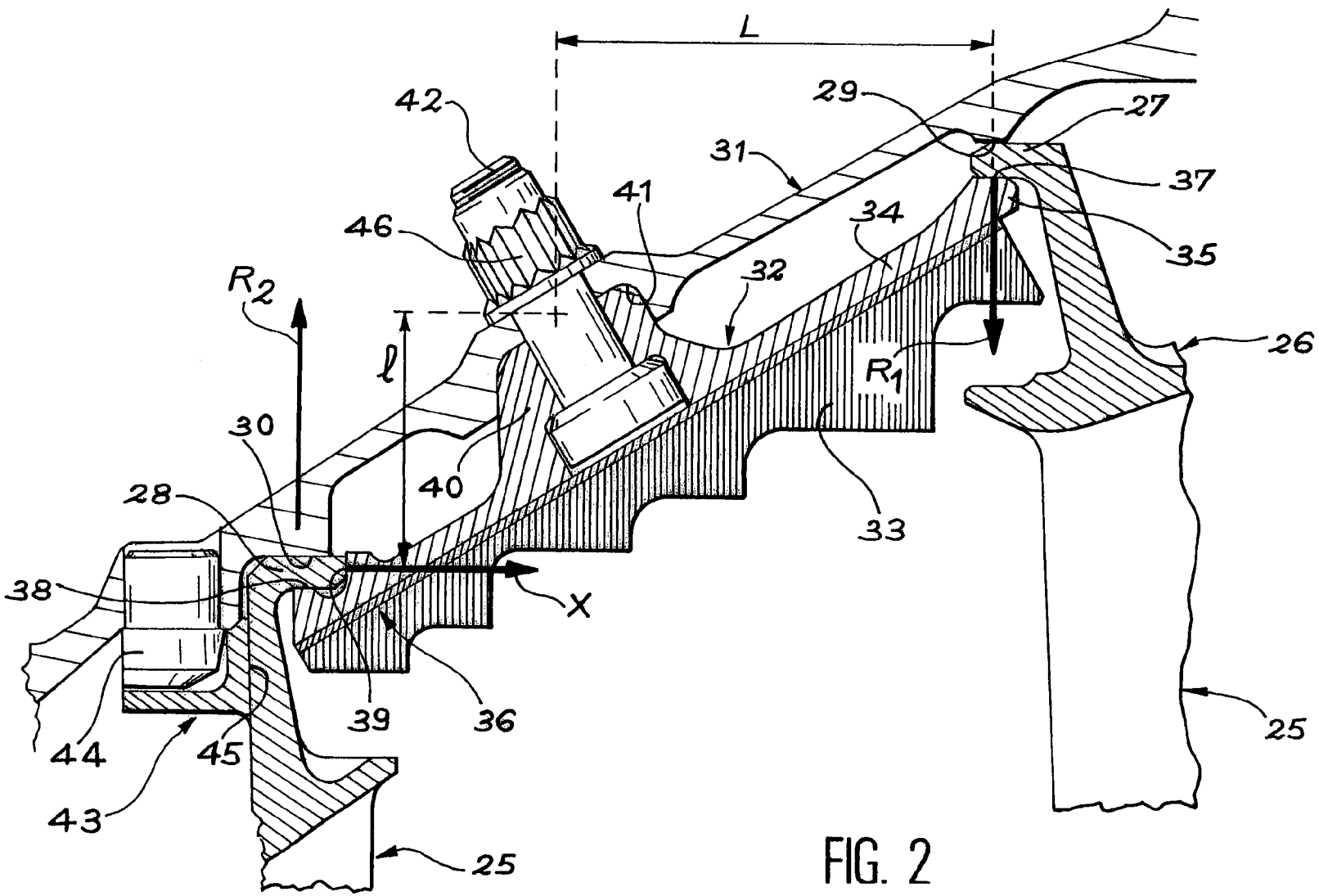

All aspects of the invention will now be described by comparing the following figures:

FIG. 1, already described, illustrates an arrangement for attachment of a known type of distributor sector;

and FIG. 2 illustrates the arrangement according to the invention in a preferred embodiment.

The overall shape of distributor sectors, which are globally denoted reference 25, is not significantly modified, and they still comprise an outer ring 26 provided with a tab 27 on the upstream side and a tab 28 on the downstream side. The tabs 27 and 28 bear on their outside faces on radial faces 29 and 30 facing the inside of the casing, which is now denoted as reference 31. Sealing sectors, now denoted 32, are still arranged alternately with the distributor sectors 25, and in addition to an abradable ring 33, they also comprise an outer ring 34 of which the downstream end 35 and the upstream end 36 clamp the tabs 27 and 28 to each other and between the bearing faces 29 and 30 of the casing 31, respectively. More precisely, the downstream end 35 supports a radial bearing face facing the outside 37 on which the centripetal radial force $R_1$, is applied, and the upstream end 36 supports a radial bearing face facing the outside 38 and an axial bearing face 39 resisting the axial force X. The outer rings 34 are connected to the casing 31 with a median portion on which a rib 40 (or a projection) is formed penetrating into a complementary shaped groove 41 (or hollow) on the casing 31 to precisely adjust the position of the sealing sectors 32. Screws 42 are engaged through the projection 40 and the casing 31 to fix the sealing sectors 32 to the casing. These screws (42) are fixed to the casing by nut 46. Another attachment means such as a force fitted pin could fill the same function.

Most forces applied on the distribution sectors 25 are resisted by sealing sectors 32. Therefore, these sealing sectors must be designed accordingly, but they will be less loaded than the hook shaped tabs of casing 2 according to the known embodiment.

The complicated and weak shapes actually disappear from the casing 31 like sealing sectors 32. The bearing faces 29 and 30 of the casing 31 are made on solid and therefore strong parts. The radial force R2 and the axial force X exerted by the tab on the downstream side 28 are exerted on different parts, which relieves the two parts.

Furthermore, the forces $R_1$ and X exert opposing moments $R_1xL$ and Xxl on the outer ring 34 about the attachment point of the screw 42 to the casing 31, and the lever arms L and 1 of the forces R and X respectively can be adjusted by making a judicious choice of the position of the screw 42 such that their moments have approximately equal or comparable values and that the bending produced on screw 42 is therefore very much reduced. Furthermore, it can be seen that the distributor sectors 25 can be installed by purely axial movements, the sealing sectors 32 then being installed behind them which is more convenient and gives more freedom in determining the layout of the machine. Overhanging parts 43 fixed to the casing 31 by pins 44 can be added to provide axial stop faces 45 for the distributor sectors 25.

Furthermore, this typical axial assembly is a means of reducing axial clearances between the stator vanes (inner ring 12 of sectors 1 in FIG. 1) and the rotor vanes (inner ring 13 of the rotor vanes 15 in FIG. 1); consequently, this reduces leakage sections (47) between the rotor and the stator making the vane assembly more efficient.

Although the view in FIG. 2 is not as complete as the view in FIG. 1, it should be understood that the invention can be extended to a group of stages of distributor sectors 25 and sealing sectors 32, and particularly that one stage of distributor sectors 25 bears at its two ends on two successive stages of sealing sectors 32, in the manner described. A particular effort has been made to show the sealing sectors 32, since the distributor sectors 25 are essentially the same as those in FIG. 1.

The invention claimed is:

1. In a turbomachine, an arrangement comprising:

a stator casing;

vanes attached to the stator casing;

distributor sectors supporting said vanes, the distributor sectors extending around arcs of a circle;

sealing sectors attached to the stator casing at attaching points by attaching means and alternating with the distributor sectors in an axial direction of the turbomachine, the sealing sectors comprising an outwardly radially oriented bearing face and an axially oriented bearing face for the distributor sectors, said outwardly radially oriented bearing face being loaded with an inwardly radially oriented force and said axially oriented bearing face being loaded with an axial force by the distributor sectors, wherein said stator casing and said sealing sectors comprise complementarily shaped hollows and projections penetrating into said hollows to adjust position of said sealing sectors, and said inwardly radially oriented force and said axial force exert moments that oppose each other with approximately equal values with respect to the attaching points of the sealing sectors, and parts fixed to said stator casing by pins, said parts being configured to provide axial stop faces for the distributor sections.

2. An arrangement according to claim 1, wherein the distributor sectors comprise tabs and the sealing sectors comprise opposite axial ends, the tabs of the distributor sectors being clamped between ends of the sealing sectors and the stator casing, and the attaching points of the sealing sectors are at an axially median position of the sealing sectors.

3. An arrangement according to claim 2, wherein the sealing sectors are attached to the stator casing by elements passing through the stator casing.

4. An arrangement according to claim 1, wherein the outwardly radially oriented bearing face is at a downstream end of the sealing sectors in the axial direction, and the axially oriented bearing face is at an upstream end of the sealing sectors in the axial direction.

5. A casing assembly for a turbomachine, comprising:

a stator casing, a first distributor sector comprising a first tab;

a second distributor sector comprising a second tab;

a sealing sector between said first and second distributor sectors, the sealing sector comprising an outwardly radially oriented bearing face and an axially oriented bearing face;

a fixation member configured to fix said sealing sector to said stator casing at a position between said outwardly radially oriented bearing face and said axially oriented bearing face, and parts fixed to said stator casing by pins, said parts being configured to provide axial stop faces for said first and second distribution sectors, wherein said first tab of said first distributor sector has a surface against said outwardly radially oriented bearing face and said second tab of said second distributor sector has a surface against said axially oriented bearing face, said first and second tabs being clamped between said stator casing and said sealing sector, and said sealing sectors and stator casing comprise complementarily shaped hollows and projections penetrating into said hollows to adjust position of said sealing sectors.

6. An assembly according to claim 5, wherein said outwardly radially oriented bearing face is configured to resist an inwardly radially oriented force generated by said first distributor sector and said axially oriented bearing face is configured to resist an axial force generated by said second distributor sector.

7. An assembly according to claim 6, wherein said inwardly radially oriented force and said axial force exert moments that oppose each other with respect to said position between said outwardly radially oriented bearing face and said axially oriented bearing face.

8. An assembly according to claim 7, wherein said moments have approximately equal values.

9. An assembly according to claim 5, wherein said position between said outwardly radially oriented bearing face and said axially oriented bearing face is at an axially median position of the sealing sector.

10. An assembly according to claim 5, wherein said fixation member comprises an element extending through the stator casing.

11. An assembly according to claim 5, wherein said sealing sector comprises an outer ring.

12. An assembly according to claim 11, wherein said outer ring has a first end comprising said outwardly radially oriented bearing face and a second end comprising said axially oriented bearing face.

13. An assembly according to claim 12, wherein said second end of said outer ring further comprises an outwardly radially oriented bearing face against an inwardly radially oriented bearing face of said second tab of said second distributor sector.

14. An assembly according to claim 12, wherein said sealing sector further comprises an inner abradable ring.

15. An assembly according to claim 5, wherein the outwardly radially oriented bearing face is at a downstream end of the sealing sector, and the axially oriented bearing face is at an upstream end of the sealing sector.

16. An assembly according to claim 5, wherein said stator casing is free of hook-shaped tabs.

17. An assembly according to claim 5, comprising a plurality of distributor sectors extending around arcs of a circle.

18. An assembly according to claim 17, comprising a plurality of sealing sectors, each sealing sector being between two adjacent distributor sectors.

19. An assembly according to claim 5, wherein said fixation member comprises a screw engaged through the stator casing.

20. An assembly according to claim 5, wherein said first and second tabs are in direct contact with said stator casing and said sealing sector.

21. In a turbomachine, an arrangement comprising:

a stator casing;

vanes attached to the stator casing;

distributor sectors supporting said vanes, the distributor sectors extending around arcs of a circle;

sealing sectors attached to the stator casing at attaching points by attaching means and alternating with the distributor sectors in an axial direction of the turbomachine, the sealing sectors comprising an outwardly radially oriented bearing face and an axially oriented bearing face for the distributor sectors, said outwardly radially oriented bearing face being loaded with an inwardly radially oriented force and said axially oriented bearing face being loaded with an axial force by the distributor sectors, wherein said stator casing and said sealing sectors comprise complementarily shaped hollows and projections penetrating into said hollows to adjust position of said sealing sectors, and parts fixed to said stator casing, said parts being configured to provide axial stop faces for said distribution sectors.

22. An arrangement according to claim 21, wherein the distributor sectors comprise tabs and the sealing sectors comprise opposite axial ends, the tabs of the distributor sectors being clamped between ends of the sealing sectors and the stator casing, and the attaching points of the sealing sectors are at an axially median position of the sealing sectors.

23. An arrangement according to claim 22, wherein the sealing sectors are attached to the stator casing by elements passing through the stator casing.

24. An arrangement according to claim 21, wherein the outwardly radially oriented bearing face is at a downstream end of the sealing sectors in the axial direction, and the axially oriented bearing face is at an upstream end of the sealing sectors in the axial direction.

* * * * *